United States Patent [19]

Askew

[11] Patent Number: 4,800,595

[45] Date of Patent: Jan. 31, 1989

[54] CIRCUMFERENTIAL SUPPRESSION SYSTEM

[76] Inventor: Robert J. Askew, 14200 - 18th Avenue, Surrey, British Columbia, Canada, V4A 7C1

[21] Appl. No.: 925,069

[22] Filed: Oct. 30, 1986

[51] Int. Cl.[4] ..... A41F 17/04; A41B 7/02

[52] U.S. Cl. ..... 2/270; 24/17 AP; 24/442

[58] Field of Search ..... 2/228, 270, 321, 162; 24/17 A, 17 AP, 442; 312/1

[56] References Cited

U.S. PATENT DOCUMENTS

| | | | |
|---|---|---|---|
| 821,977 | 5/1906 | Barker | 2/270 |
| 1,110,534 | 9/1914 | Chamberlain | 24/17 A |
| 1,464,126 | 8/1923 | Brummer | 2/228 |
| 1,662,074 | 3/1928 | McMeans | 2/321 X |
| 1,784,785 | 12/1930 | Douglis | 2/228 |
| 4,112,521 | 9/1978 | Uke | 24/442 X |
| 4,388,733 | 6/1983 | Anstett | 2/162 X |
| 4,471,495 | 9/1984 | Kruse et al. | 2/162 |

FOREIGN PATENT DOCUMENTS

| | | | |
|---|---|---|---|
| 16660 | of 1903 | United Kingdom | 2/162 |

*Primary Examiner*—Wm. Carter Reynolds

[57] ABSTRACT

A circumferential suppression system is disclosed. It is designed for use wherever an adjustment requiring a loose fit up to and including a tight seal is to be made. It can be effective in reducing and preventing the entry of cold air, water, toxic gases and vapours and other harmful or undesirable fluids. It is adopted to be used with garments and articles made of suppled material. It is comprised of a drawline having one end attached to the article and a free end adapted to be led along the circumference of the article to a return anchor point and led back along itself to a pivoting anchor point attached near the attached end of the drawline. The return anchor point is attached to the article at a point along the circumference, opposite the attached end of the drawline.

6 Claims, 1 Drawing Sheet

CIRCUMFERENTIAL SUPPRESSION SYSTEM

FIELD OF THE INVENTION

This invention relates to adjustable closure systems and more particularly to a circumferential suppression system for use with garments and articles made of supple material.

DESCRIPTION OF THE PRIOR ART

Garments and articles of clothing which require an adjustment to be made from a loose fit up to and including a tight seal around the wrist and legs or other parts of the body have used a number of adjustment belts and the like. These are sometimes awkward to use in that the garment will twist and turn upon tightening and in most instances will not provide a tight seal when required.

This is particularly important in instances where thermal protective clothing is worn. In this type of clothing, the user must ensure an effective circular seal around the wrist and legs in order to minimize water exchange and therefore enhance thermal protection performance of the garment.

Similarly, protective clothing used in environments which contain toxic gases and vapours and other harmful or undesirable fluids require a means to ensure an effective circular seal around the wearers limbs.

Ideally, the suppression, adjustment or sealing should be achieved fairly quickly, easily and preferably requiring the use of only one hand.

SUMMARY OF THE INVENTION

It is therefore an object of the present invention to provide a circumferential suppression system which will alleviate the aforementioned problems.

Another object of the present invention is to provide a circumferential suppression system able to provide adjustments from a loose fit up to and including a tight seal.

Another object of the present invention is to provide a circumferential suppression system for use with thermal protective clothing which will effectively reduce the entry of cold air and water to minimize water exchange and enhance thermal protection.

Yet another object of the present invention is to provide a circumferential suppression system for use with environmental protective clothing which will effectively prevent the ingress of toxic gases and vapours and other harmful or undesirable fluids.

Accordingly, an aspect of the present invention is to provide a circumferential suppression system for garments and articles made of supple material, comprising: a drawline having one end attached to said article and a free end adapted to be led along the circumference of said article to a return anchor point so as to be led back along itself to a pivoting anchor point attached near said attached end of said drawline, said return anchor point being attached to said article at a point along said circumference, opposite said attached end of said drawline.

DRAWINGS

Particular embodiments of the invention will be understood in conjunction with the accompanying drawings in which.

DESCRIPTION OF THE PREFERRED EMBODIMENTS

Figure 1:
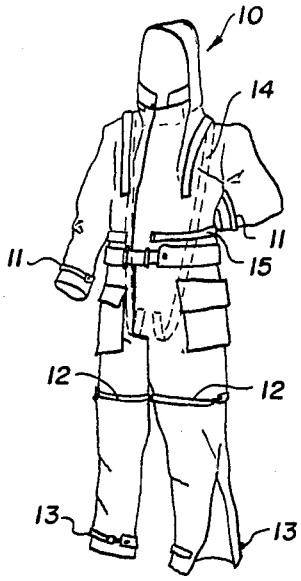
FIG. 1 is a perspective illustration of a typical thermal protective suit which can be used in the present invention.

Referring now to FIG. 1 we have shown at reference numeral 10 an illustration of a typical thermal protective suit on which can be installed the circumferential suppression system of the present invention. The circumferential suppression system of the present invention is used wherever an adjustment requiring a loose fit up to and including a tight seal is to be made. For example, the circumferential suppression system could be used at the wrist 11, legs 12, ankles 13, torso 14 and waist 15.

Although the circumferential suppression system of the present invention will be described for use with protective clothing, other applications will be readily known to those knowledgeable in this art. For example, the suppression system could be used with duffle bags, hiking gear such as pack sacks and tents as well as sleeping bags. Basically, wherever an adjustable closure system is required to effectively reduce or prevent the entry of cold air, water, toxic gases and vapours and other harmful or undesirable fluids.

Figure 2:
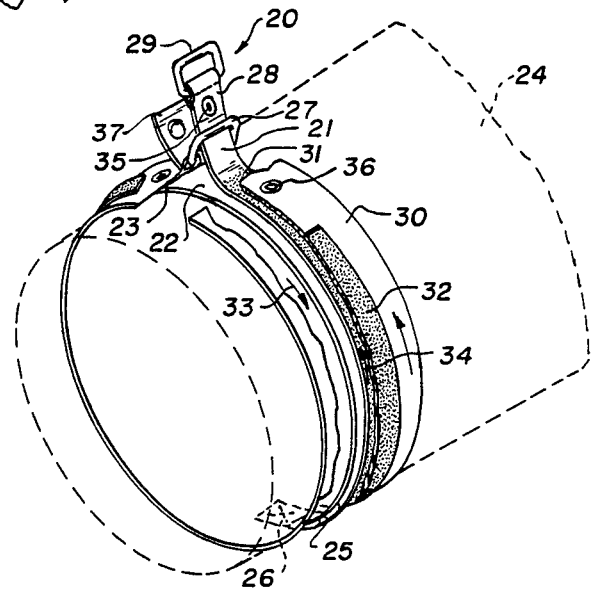
FIG. 2 is a partially sectioned view of the circumferential suppression system according to an embodiment of the present invention.

Referring now to FIG. 2, the circumferential suppression system is shown at reference numeral 20. It is shown positioned around the circumference of a garment, article of clothing or an article made of supple material.

The circumferential suppression system 20 is comprised of a drawline 21 having a first end 22 secured at 23 to say a sleeve 24. Drawline 21 has been led partly around the circumference of sleeve 24 to a return anchor point 25 which consists of a D-ring secured to sleeve 24 at the opposite end of first end 22 by means of a piece of material 26 forming a loop around the D-ring 25 and sewn in place. This return anchor point permits drawline 21 to be led back over itself and around a pivoting anchor point 27. The free end 28 of drawline 21 is provided with D-ring 29 to prevent free end 28 from passing through pivoting anchor point 27.

A pocket 30 is used to enclose the drawline 21 and is used as a retaining means to enhance and provide a more generally even radial collapse, contraction or shrinkage of the material between anchor points 25 and 27 when drawline 21 is pulled to seal the opening. A generally even radial contraction of material prevents large folds with channels from forming in the material and hence reduces the possibility of ingress of water. Pocket 30 and drawline 21 are provided with a hook 31 and loop 32 fastening arrangement commonly called Velcro TM. This securing arrangement permits the drawline 21 to be secured around the circumference of sleeve 24 when it is pulled to tighten the sleeve around the arm.

Figure 3:
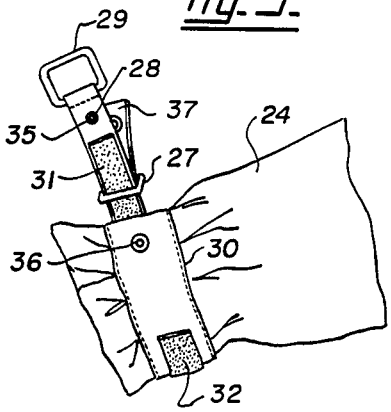
FIG. 3 is a right side view thereof.

As depicted in FIG. 3, by pulling the free end 28 of drawline 21, the sleeve 24 collapses thereby creating a tight seal around the arm or wrist of the user. The circumferential suppression system eliminates the circular torsion or rotation that would exist if the drawline was secured at only one end of the sleeve. As shown in FIG. 2, by having drawline 21 return over itself, the direction of pull of the bottom or inner drawline, depicted by arrow 33 is cancelled by the direction of pull of the upper or outer drawline, depicted by arrow 34.

Once the free end 28 of drawline 21 has been pulled to form the tight seal, the drawline is wrapped around the circumference of the sleeve and secured thereon by means of Velcro TM pads 31 and 32.

Figure 4:
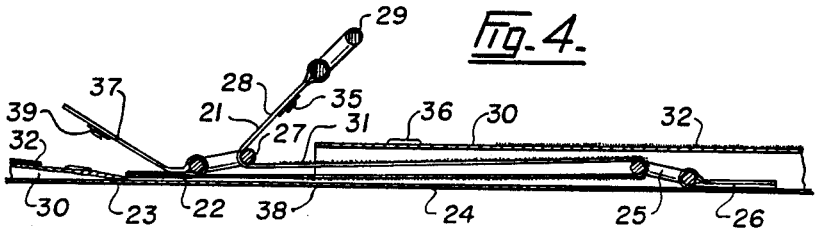
FIG. 4 is an illustrative sectional view of the circumferential suppression system of the embodiment shown in FIG. 2.

Referring now to FIG. 4 the cross sectional view of the circumferential system shown in FIG. 2 will be further described. The circumferential suppression system of the present invention acts in effect as a pulley system and will provide a 2 to 1 mechanical advantage when the drawline is pulled. This is achieved by the use of return anchor point 25 and pivoting anchor point 27 which act as first and second load reversal points.

Free end 28 of drawline 21 is provided with a press fitted fastener 35 which is used in conjunction with fastener 36 on pocket 30. These fasteners are used when the circumferential system is not being used so as to prevent free end 28 from becoming entangled.

The circumferential suppression system is provided with an integrated reverse tab 37 which is used to release tension that will still exist around the circumference of the sleeve once the free end 28 of drawline 21 has been removed from the Velcro TM fastener. The material 38 which has collapsed between anchoring point 25 and 27 can more easily be stretched to its normal configuration by pulling on tab 37. The return drawline 21 which is secured around the sleeve by Velcro attachment 32 should of course be released beforehand.

The circumferential suppression system of the present invention has been designed such that a relatively weak pulling force on drawline 21 will help create a relatively tight seal around the circumference of the sleeve or other article of material which will be sufficient to prevent or minimize water exchange and effectively reduce the entry of cold air, water, toxic gases and vapours and other harmful or undesirable fluids. Also, the inherent designed features of the system will prevent the twisting and turning of the sleeve thereby requiring a single hand to adjust it.

As will be apparent to those skilled in the art in light of the foregoing disclosure, many alterations and modifications are possible in the practise of this invention without departing from the spirit or scope thereof. Accordingly, the scope of the invention is to be construed in accordance with the substance defined by the following claims.

I claim:

1. A circumferential suppression system for garments and articles made of supple material, comprising:

a drawline having one end attached to said article and a free end adapted to be led around the said article to a return anchor point remote from said attached end, said drawline being led back along itself from said return anchor point to a pivoting anchor point attached near said attached end of said drawline;

retaining means for said drawline comprising a pocket attached around said article and substantially enclosing the length of said drawline, said pocket extending from said attached end of said drawline around said article, over said return anchor point to said pivoting anchor point; and securing means on said drawline and said pocket to allow said drawline to be removably attached to said pocket around said article;

said return anchor point forming a first load reversal point and said pivoting anchor point forming a second load reversal point, such that, in combination, said first and second load reversal points provide a mechanical advantage and prevents torsion of said article when said free end of said drawline is pulled away from said pivoting anchor point to cause a generally even radial contraction of material between said return anchor point and said pivoting anchor point, whereupon said drawline can be removably secured to said pocket by said securing means to maintain said contraction.

2. A circumferential suppression system as defined in claim 1 further comprising release means attached at said pivoting anchor point to allow for reversal of the contraction of said material when said drawline is released.

3. A circumferential suppression system as defined in claim 1 wherein said securing means comprises hook and loop fasteners.

4. A circumferential suppression system as defined in claim 2 wherein said release means comprises a tab extending away from said pivoting anchor point whereby pulling on said tab will allow said contraction of said material to be stretched to an uncontracted state.

5. A circumferential suppression system as defined in claim 1 wherein said pivoting anchor point comprises a D-ring secured at said attached end of said drawline.

6. A circumferential suppression system as defined in claim 1 wherein said return anchor point comprises a D-ring secured to said article.

* * * * *